US011371187B2

(12) United States Patent
Gronych et al.

(10) Patent No.: US 11,371,187 B2
(45) Date of Patent: Jun. 28, 2022

(54) PRESS SECTION

(71) Applicant: Voith Patent GmbH, Heidenheim (DE)

(72) Inventors: Daniel Gronych, Heidenheim (DE); Richard Horn, Herbrechtingen (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 17/134,613

(22) Filed: Dec. 28, 2020

(65) Prior Publication Data

US 2021/0115625 A1 Apr. 22, 2021

Related U.S. Application Data

(63) Continuation of application No. PCT/EP2019/062928, filed on May 20, 2019.

(30) Foreign Application Priority Data

Jul. 4, 2018 (DE) ..... 10 2018 116 125.5

(51) Int. Cl.

| | |
|---|---|
| ***D21F 3/04*** | (2006.01) |
| ***D21F 7/00*** | (2006.01) |
| ***D21F 7/08*** | (2006.01) |

(52) U.S. Cl.

CPC ..... *D21F 3/045* (2013.01); *D21F 7/008* (2013.01); *D21F 7/08* (2013.01)

(58) Field of Classification Search

CPC . D21F 3/045; D21F 7/008; D21F 7/08; D21F 3/04; D21F 11/00

See application file for complete search history.

(56) References Cited

U.S. PATENT DOCUMENTS 5,681,431 A 10/1997 Steiner
5,762,761 A * 6/1998 Kivimaa ..... D21F 3/04 162/360.2

(Continued)

FOREIGN PATENT DOCUMENTS

DE 100 18 367 A1 11/2000
DE 10 2004 042 637 A1 3/2006

(Continued)

OTHER PUBLICATIONS

Notification of the Transmission of the International Search Report and Written Opinion of the International Search Authority or Declaration dated Aug. 20, 2019 for International Application No. PCT/EP2019/062928 (13 pages).

(Continued)

*Primary Examiner* — Eric Hug
*Assistant Examiner* — Matthew M Eslami
(74) *Attorney, Agent, or Firm* — Taylor IP, P.C.

(57) ABSTRACT

A press section which includes first and second press nips and at least one separate continuously revolving press belt which is routed around each press element of each press nip over a plurality of guide rollers. An upper press belt is led away from the fibrous web after the first press nip. Thereafter the fibrous web is transferred from a lower press belt of the first press nip to an upper press belt of the second press nip. The upper press belt of the second press nip wraps around a vacuum assisted guide roller. Thereafter the lower press belt of the second press nip is brought into contact with the fibrous web via a guide roller, after which the fibrous web travels to the second press nip via a guided path jointly with the two opposite upper and lower press belts of the second press nip.

13 Claims, 1 Drawing Sheet

(56) References Cited

U.S. PATENT DOCUMENTS

| | | | | |
|---|---|---|---|---|
| 5,833,810 | A * | 11/1998 | Laapotti | D21F 3/045 162/360.3 |
| 6,730,192 | B1 | 5/2004 | Laapotti | |
| 2008/0156450 | A1 * | 7/2008 | Klerelid | D21F 11/006 162/203 |

FOREIGN PATENT DOCUMENTS

| | | | |
|---|---|---|---|
| DE | 10 2011 082 161 | A1 | 3/2013 |
| WO | 01/40573 | A1 | 6/2001 |

OTHER PUBLICATIONS

German Office Action dated Mar. 12, 2019 for German Patent Application No. 10 2018 116 125.5 (8 pages).

* cited by examiner

PRESS SECTION

CROSS REFERENCE TO RELATED APPLICATIONS

This is a continuation of PCT application No. PCT/EP2019/062928, entitled "PRESS SECTION", filed May 20, 2019, which is incorporated herein by reference.

BACKGROUND OF THE INVENTION

1. Field of the Invention

The invention relates to a press section in a machine for producing a fibrous web, in particular a paper, cardboard or tissue web, having two press nips, positioned one after the other in direction of web travel and respectively formed by two press elements.

2. Description of the Related Art

A press of the type referred to at the beginning is known, for example from DE 10 2011 082 A1. The press section described therein includes a plurality of press nips, each having two belt-type continuously revolving clothing in the embodiment of a bottom felt and a top felt which are led over several guide rollers.

After each press nip the bottom felt and the top felt are separated at a point of separation, in order to carry the fibrous web forward on the bottom felt.

A suction device in the form of a vacuum assisted guide roller or a suction box of the bottom felt which is arranged at the point of separation serves to hold the fibrous web at the point of separation on the bottom felt.

After the transfer of the fibrous web to the upper felt of the subsequent press nip, problems arise in regard to adhesion of the web on the upper felt, in particular at high machine speeds and/or high basis weights and high dry contents.

What is needed in the art is a press section that improves the scope of application and which has a web travel that is as reliable as possible and/or provides the greatest possible dewatering performance.

SUMMARY OF THE INVENTION

The invention provides a press section in a machine for producing a fibrous web, in particular a paper, cardboard or tissue web, having two press nips, positioned one after the other in direction of web travel and respectively formed by two press elements. At least one separate continuously revolving press belt is routed around each press element over a plurality of guide rollers. The upper press belt is led away from the fibrous web after the first press nip. Thereafter the fibrous web is transferred from the lower press belt of the first press nip to the upper press belt of the second press nip. The upper press belt wraps around a vacuum assisted guide roller. Thereafter, the lower press belt of the second press nip is brought into contact with the fibrous web via a guide roller, after which the fibrous web travels to the second press nip via a guided path, jointly with the two opposite press belts.

According to the invention the guide roller is positioned such that the guide roller is wrapped by the lower press belt of the second press nip before the beginning of the guided path can be varied in a manner that changes the length of the guided path. The press section further includes a steam blow box, the blow nozzles of which are directed onto the fibrous web and which can be moved in front of this variable guide roller with the guided path shortened below the fibrous web.

The dry content of the web and thus the dewatering performance of the press section can be substantially increased by applying steam to the steam blow box. Impairment of the fibrous web due to dripping condensation water—which would be a concern with steam blow boxes that are arranged above the fibrous web—is impossible here.

With a shorter guided path as a result of a corresponding change in location of the variable guide roller, sufficient space remains for a steam blow box, between the vacuum assisted guide roller and the start of the guided path below the fibrous web.

The blow nozzles of the steam blow box that are directed onto the fibrous web herein also counteract the fibrous web dropping off the lower press belt.

If however, because of the high basis weight of the fibrous web and/or because of high machine speeds, lift-off of the fibrous web, in particular at the edges is still an issue of concern, then the steam blow box can be moved and the start of the guided path can be extended via a positional change of the variable guide roller in the direction of the vacuum assisted guide roller of the upper press belt.

In this case, that is in the case of the extended guided path, the upper press belt of the second press nip should bridge a distance of at 500 mm maximum, for example less than 300 mm and in particular at most 200 mm between the vacuum assisted guide roller and the guided path.

With this, the press section can be arranged substantially more flexible in regard to fibrous web types, basis weight, and machine speed with relatively low effort than previously.

For a structurally simple adaptation, the variable guide roller and the steam blow box should be mechanically coupled with one another, for instance joined together.

In regard to the positional change of the variable guide roller—in particular if it is coupled with the steam blow box—it can be constructively advantageous if the guide roller is arranged to pivot. The variable guide roller together with the steam blow box should herein be swivel-mounted between two positions, wherein the steam blow box with its blow nozzles is directed onto the moving fibrous web only in one pivoted position; specifically in the case of the shortened guided path, before the guided path, viewed in direction of web travel.

In the case of the extended guide path, the steam blow box is pivoted out from this transfer region of the fibrous web.

So as not to impair the belt travel path of the upper press belt during normal operation, the variable guide roller of the lower press belt should redirect the upper press belt of the second press nip as little as possible, for instance only between the two pivot positions. The pivoting motion may occur during standstill of the machine or at reduced machine speed.

Due to the space problems in the transfer region of the fibrous web, the distance of the steam blow box to the pivot axis should be variable. Thereby, the steam blow box—when activated—can be moved as closely as possible to the fibrous web and can be moved as closely as possible to the pivot axis when pivoting.

In particular, if the blow nozzles are not activated, they can easily become dirty which shortens the service life of the steam blow box considerably. It is therefore advantageous if a cover is allocated to the steam blow box, which may only release the blow nozzles when they are directed onto the fibrous web in its travel before the guided path, and an activation is imminent.

If the geometry of the belt travel path is to be largely maintained in the event of a conversion of the press section, this can be accomplished via an additional guide roller which is coupled with the variable guide roller and which, viewed in direction of belt travel is located before the variable guide roller and outside the belt travel path. For this purpose, the additional guide roller should only engage in the travel path of the lower press belt in the case of the extended guided path.

It is advantageous for a reliable web travel if the fibrous web prior to both press nips runs in each case through a guided path, together with two press belts that are located opposite one another. The two-sided guidance of the fibrous web in the guided path is reliable and stable even at high speeds and prevents damage to the fibrous web.

For the purpose of intensive and gentle dewatering, at least one press nip should be extended and may have a compaction pressure of >900 kN/m and/or a press nip length of >200 mm.

The formation of the press nip is especially simple if the press elements are in the embodiment of press rolls.

Because of the enormous amount of water in the press nips during dewatering, the press belts should be designed as continuous revolving water-absorbing press felts.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates an embodiment of the invention, in one form, and such exemplification is not to be construed as limiting the scope of the invention in any manner.

DETAILED DESCRIPTION OF THE INVENTION

Figure 1:
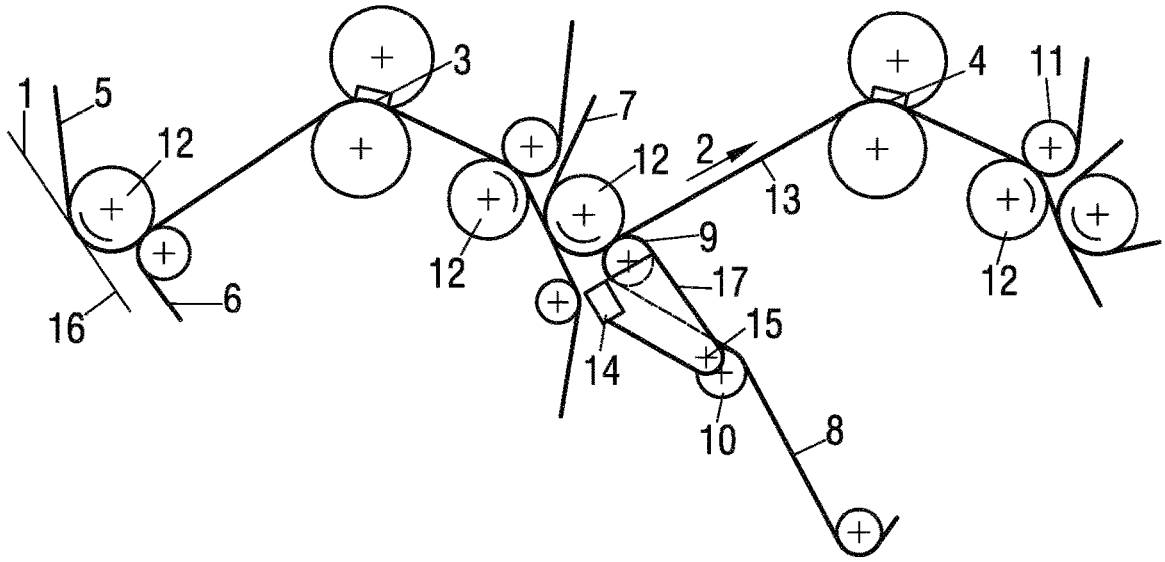
FIG. 1 is a schematic view of an embodiment of a press section with a long guided path prior to the second press nip.
Figure 2:
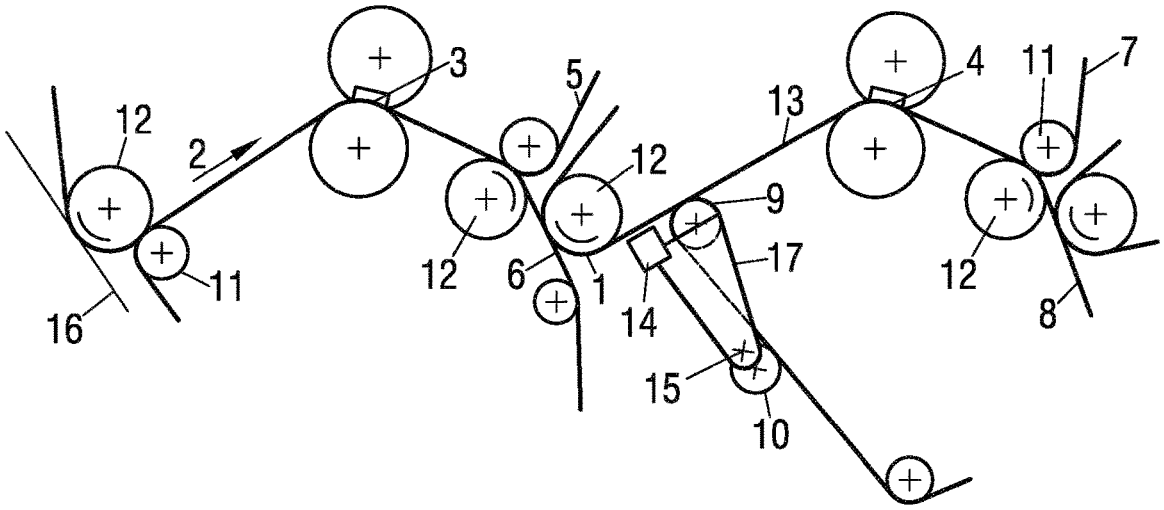
FIG. 2 is a schematic view of the press section with a shortened guided path.

Referring now to FIGS. 1-2, there is shown a press section in a machine for producing a fibrous web 1. Here, fibrous web 1 is guided for dewatering through two press nips 3, 4 which are located one behind the other viewed in direction of web travel 2 and each of which consist of two press rolls pressing against each other. Each press roll has its own continuous revolving press belt 5, 6, 7, 8 in the embodiment of a water-absorbing press felt for absorption and removal of the water pressed out of fibrous web 1, which is guided over several guide rollers 9, 10, 11, 12.

To ensure a stable web travel, fibrous web 1 is guided in a guided path 13 prior to and after each press nip 3, 4, jointly with the two press belts 5, 6, 7, 8 of press nip 3, 4.

Removal of fibrous web 1 occurs by way of a screen 16 of an upstream former. In addition, press nips 3, 4 are elongated through the use of press rolls which, in this case are arranged on top and which are in the embodiment of shoe press rolls. These shoe press rolls have a flexible roll shell which is pressed against the other press roll by a press shoe with a concave contact surface.

The length of the press shoe in direction of web travel 2 is at least 200 mm. The compaction pressure in press nip 3, 4 is at least 900 kN/m.

In order to enable the transfer of fibrous web 1 to a downstream unit, for example an additional press nip or a dryer group of a downstream dryer section for drying of the fibrous web, a press belt 5, 7 is guided away from fibrous web 1 after guided route 13 that follows in each case after a press nip 3, 4. During aforementioned guidance of a press belt 5, 7 the opposite press belt, in this case always lower press belt 6, 8 runs together with fibrous web 1 along a suction element, in particular in the embodiment of a rotating vacuum assisted guide roller 12. Such vacuum assisted guide rollers are expensive but ensure reliable web travel even at high machine speeds of 1000 m/min or higher, and at medium and high basis weights of up to 250 g/m$^2$.

To adapt to the special requirements, vacuum assisted guide roller 12 has several suction zones.

After first press nip 3 and leading away of its upper press belt 5, fibrous web 1 is transferred from its lower press belt 6 to upper press belt 7 of second press nip 4, wherein said press belt 7 wraps around a vacuum assisted guide roller 12.

Thereafter, lower press belt 8 of second press nip 4 is brought into contact with fibrous web 1 via a guide roller 9, the position of which can be changed, and which thereafter is referred to as variable guide roller 9. From here on, fibrous web 1 travels to second press nip 4 via guided path 13, together with the two opposing press belts 7, 8.

Variable guide roller 9 is connected via a pivot arm 17 with a pivot axis 15 located below guide roller 9 and is thus pivot-mounted between two operating positions.

In a first operating position according to FIG. 1 variable guide roller 9 is arranged very closely to vacuum assisted guide roller 12 which supports transfer of fibrous web 1 to upper press belt 7 of second press nip 4. Guided path 13 is designed accordingly long.

According to FIG. 2 variable guide roller 9 is brought into a second operating position through pivoting in direction of web travel 2. This shortens guided path 13 to second press nip 4 accordingly. Therefore, the guided path 13 can have an extended position and a shortened position.

Variable guide roller 9 engages into the path of upper press belt 7 of second press nip 4 only during pivoting, that is to say between the two operating positions. This is why pivoting occurs at reduced machine speed or during standstill.

On pivot arm 17 of variable guide roller 9 a steam blow box 14 is mounted in opposite direction to the direction of web travel 2, the distance of which to pivot axis 15 is variable.

The first operating position according to FIG. 1 with long guided path 13 is especially suitable for heavy fibrous webs and/or high machine speeds of, for example speeds higher than 1200 m/min. After transfer of fibrous web 1 to upper press belt 7, lower press belt 8 of second press nip 4 is delivered early, resulting in a highly reliable and stable web guidance. The downwardly unsupported section between receiving guide roller 12 and the following guided path 13 is herein at most 500 mm, preferably at most 300 mm and in particular less than 200 mm.

Since the transfer region is designed to be very compact, steam blow box 14 is moved downward in this operating position, thereby reducing the distance to pivoting axis 15.

At low machine speeds and/or light fibrous webs 1 of for example less than 160 g/m$^2$, the second operational position according to FIG. 2 with the shortened guided path 13 may be selected. Since the adhesion of fibrous web 1 on upper press belt 7 is relatively strong, it can—after wrapping around transfer-supporting vacuum assisted guide roller 12—still run downwardly unsupported over a relatively long distance to guided path 13. This unsupported section offers sufficient space for steam blow box 14 which, in this operational position is moved from below toward fibrous web 1 and thus away from pivoting axis 15.

For supplying steam to fibrous web 1, steam blow box 14 has several blow nozzles directed onto fibrous web 1. The steam application can occur in separate zones, transversely relative to the direction of web travel 2, allowing the moisture cross profile of fibrous web 1 to be influenced. In addition, the dewatering capacity of the press section can be increased by 1 to 2% by way of the steam application.

Because of the high contamination risk, steam blow box 14 has a cover which only releases the blow nozzles when they are directed onto the running fibrous web prior to guided path 13, that is to say only in the operating position with shortened guided path 13.

In order to be able to maintain the belt travel geometry even on conversions, an additional guide roller 10 is mounted on pivoting arm 17 below pivoting axis 15. Viewed in direction of belt travel, said guide roller 10 is arranged immediately before variable guide roller 9, but outside the travel path of lower press belt 8.

This additional guide roller 10 only engages into the travel path of lower press belt 8 in the operating position with the extended guided route 13, thereby rerouting it.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press section in a machine for producing a fibrous web, comprising:

a pair of press nips comprising a first press nip and a second press nip, the first press nip and the second press nip being positioned one after the other in a direction of web travel, the pair of press nips being respectively formed by a pair of press elements;

a plurality of guide rollers comprising a variable guide roller and a vacuum assisted guide roller, the variable guide roller being between the first press nip and the second press nip in the direction of web travel, the vacuum assisted guide roller being located after the first press nip in the direction of web travel, the variable guide roller having a pivot arm;

at least one separate continuously revolving press belt being routed around each press element over the plurality of guide rollers, the at least one separate continuously revolving press belt comprising a first upper press belt, a second upper press belt, a first lower press belt, and a second lower press belt; and a steam blow box located between the first press nip and the variable guide roller, the steam blow box being below the fibrous web, the steam blow box being mounted to the pivot arm of the variable guide roller, wherein the first upper press belt is led away from the fibrous web after the first press nip, wherein thereafter the fibrous web is transferred from the first lower press belt of the first press nip to the second upper press belt of the second press nip, wherein the second upper press belt wraps around the vacuum assisted guide roller, wherein thereafter the second lower press belt of the second press nip is brought into contact with the fibrous web via the variable guide roller, after which the fibrous web travels to the second press nip via a guided path jointly with the second upper press belt and the second lower press belt which face opposite to one another, wherein a position of the variable guide roller, which is wrapped by the second lower press belt of the second press nip before a beginning of the guided path, can be varied in a manner that changes a length of the guided path, wherein the steam blow box can be moved in front of the variable guide roller with the guided path being shortened below the fibrous web.

2. The press section according to claim 1, wherein the variable guide roller and the steam blow box are mechanically coupled with one another.

3. The press section according to claim 2, wherein the variable guide roller and the steam blow box are joined together.

4. The press section according to claim 1 wherein the variable guide roller is pivotable.

5. The press section according to claim 4, wherein the variable guide roller redirects the second upper press belt of the second press nip.

6. The press section according to claim 4, wherein the variable guide roller is pivotally mounted at a pivot axis, wherein a distance of the steam blow box to the pivot axis is variable.

7. The press section according to claim 6, wherein the pivot arm mounts the variable guide roller such that the pivot axis is located below the variable guide roller.

8. The press section according to claim 1, wherein the plurality of guide rollers further comprises an additional guide roller which is coupled with the variable guide roller, which is located before the variable guide roller and outside a belt travel path.

9. The press section according to claim 8, wherein the additional guide roller only engages in a travel path of the second lower press belt in an extended position of the guided path.

10. The press section according to claim 9, wherein in the extended position of the guided path, the second upper press belt of the second press nip bridges a distance of 500 mm at maximum between the vacuum assisted guide roller and the guided path.

11. The press section according to claim 10, wherein the distance is less than 300 mm.

12. The press section according to claim 1, wherein at least one press nip of the pair of press nips is extended.

13. The press section according to claim 1, wherein the press elements are in the form of press rolls.

* * * * *